United States Patent [19]

Grinwald

[11] Patent Number: 4,909,128

[45] Date of Patent: Mar. 20, 1990

[54] MINE ROLLER ASSEMBLY

[76] Inventor: Israel M. Grinwald, 7206 Silver Leaf Ct., West Bloomfield, Mich. 48322

[21] Appl. No.: 277,592

[22] Filed: Nov. 25, 1988

[51] Int. Cl.[4] ..... F41H 11/12

[52] U.S. Cl. ..... 89/1.13

[58] Field of Search ..... 89/1.13, 1.1; 280/481

[56] References Cited

U.S. PATENT DOCUMENTS

| | | | |
|---|---|---|---|
| 1,190,257 | 7/1916 | Henderson | 89/1.13 |
| 2,287,723 | 6/1942 | Boyd et al. | 89/1.13 |
| 2,455,636 | 12/1948 | Woolson | 89/1.13 |
| 2,489,349 | 11/1949 | White | 89/1.13 |
| 2,500,970 | 3/1950 | Walker | 89/1.13 |
| 3,771,413 | 11/1973 | Sieg et al. | 89/1.13 |
| 4,693,164 | 9/1987 | Grinwald | 89/1.13 |
| 4,723,473 | 2/1988 | Grinwald | 89/1.13 |

FOREIGN PATENT DOCUMENTS

| | | | |
|---|---|---|---|
| 2632568 | 1/1978 | Fed. Rep. of Germany | 89/1.13 |
| 909874 | 5/1946 | France | 89/1.13 |
| 997365 | 1/1952 | France | 89/1.13 |

*Primary Examiner*—David H. Brown

[57] ABSTRACT

Disclosed is a mine roller for attachment to a military vehicle such as a tank. The mine roller includes a frame vertically swingably connected to the tank and a set of disks mounted to the frame for eccentric rotation thereon. A ground engagement annulus is rotatable on the outer diametrical surface of each disk to provide rolling contact between the mine roller and the ground. The frame of the mine roller extends no further from the tank than do the annuluses, thereby minimizing interference between the frame and the ground. The mine roller also has means to limit the swinging of the mine roller relative to the tank, the limiting means including a cantilever arm or spring fixed to the mine roller frame and engagable with the tank after the mine roller swings a predetermined amount.

14 Claims, 3 Drawing Sheets

MINE ROLLER ASSEMBLY

GOVERNMENT INTEREST

The invention described herein may be manufactured, used, and licensed by or for the Government for governmental purposes without payment to me of any royalty thereon.

BACKGROUND

The invention herein is a mine roller used to detonate buried land mines in the path of a tank or other vehicle. A mine roller typically comprises a frame upon which are mounted a set of heavy wheels or wheel-like structures. The mine roller is pivotally connected to the tank so that it can swing up or down relative to the tank, and thereby more effectively follow terrain contours. When the mine roller is pushed ahead of a tank through a mine field, the weight of the wheels triggers the buried mines.

Mine explosions throw the mine roller upward and rearward toward the tank. Mine rollers typically include means to limit such upward, rearward motion so as to protect structures mounted on the turret or on the upper hull of the tank. After being stopped in their upward, rearward motion, mine rollers rebound downward toward the hole created by the mine explosion. If the roller rebounds into the hole, the tank may run over the roller, damaging itself or the roller, and possibly immobilizing the tank. Therefore, mine rollers normally include a mechanism to prevent the downward rebound. One rebound prevention means is a cable assembly connected between the front upper hull of a tank and the frame of the mine roller. Typical cable assemblies are relatively expensive, cannot reliably survive more than 4 or 5 mine explosions, and are difficult to install on a tank. One such assembly is found on the M1A1 tank currently used by the U.S. Army. For the cable assembly on the M1A1 tank, it is also necessary to have a winch on the tank for raising the forward end of the mine roller in order to attach the mine roller to tank.

Another problem encountered with conventional mine rollers occurs when using them on rough terrain, particularly when steep ridges or deep ditches are encountered. Often a portion of the mine roller frame will not clear obstacles at the peak of a ridge or will dig into the side of a steep slope as the mine roller travels. When the mine roller thus fails to negotiate the terrain, both it and the tank are sometimes immobilized, whereby a mine field fails to be cleared and a special retrieval may be needed to rescue the tank. Retrieval may be hazardous or impossible in combat situations and the tank crew may then face life-threatening danger when escaping from the tank.

SUMMARY OF THE INVENTION

My invention is a mine roller with an improved ability to negotiate rough terrain and avoid immobilization. My invention includes wheel-like structures specially placed on a mine roller frame so as to minimize the frame's contact with the ground on uneven terrain. At the same time, the wheel-like structures and their mounting mechanisms are configured to provide a uniquely simple, rugged mechanism to maintain maximum rolling contact between the mine roller and the ground over rough terrain. In addition, my invention has an improved mechanism to limit the upward, rearward motion of the mine roller after it detonates a mine, this mechanism including a relatively inexpensive anti-rebound means to keep the mine roller out of mine explosion craters. My anti-rebound means can survive 12 or more mine explosions, thereby enhancing the mine rollers's ability to keep functioning as it passes through a mine field.

DETAILED DESCRIPTION

Figure 1:
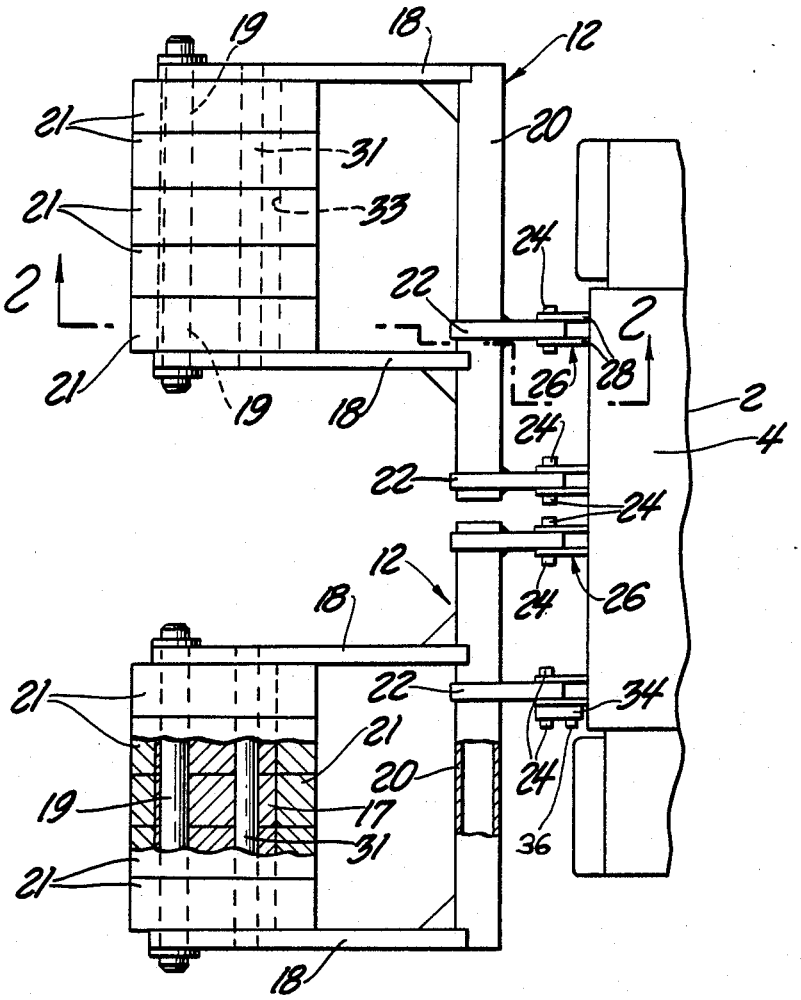
FIG. 1 is a plan view of my mine roller including the front of a tank to which the mine roller is attached.
Figure 2:
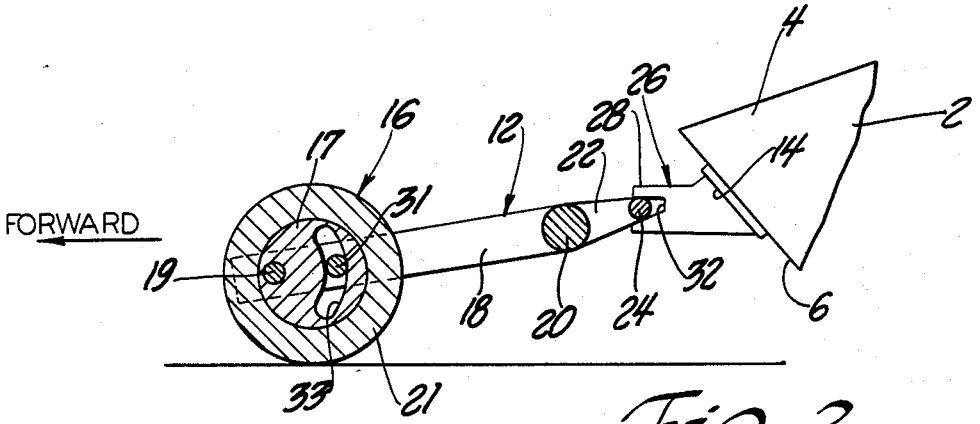
FIG. 2 is a sectional view taken along line 2—2 in FIG. 1.

Referring to FIGS. 1 and 2, the front portion of a tank hull is shown at 2 having an upper or glazier surface 4 and a lower surface 6. Fixed on lower surface 6 are bracket assemblies 26 having a flat base member 14 from which extend a parallel pair of bracket arms 28. At the forward end of arms 28 are slots 32 for receiving transverse pins 24 on plates 22 which fit between bracket arms 28. One arm in each bracket assembly 26 has a latching mechanism thereon, which can comprise a hook 34 rotating on a rod 36 shown on the lowermost bracket assembly in FIG. 1. For illustrative clarity, the latching mechanism is not shown on the other bracket assemblies 26 in FIG. 1 and is not shown in FIG. 2, but is shown separately in FIG. 4.

Plates 22 are a component of mine roller frame 12, plates 22 being fixed to the frame's transverse beam 20 disposed in front of the tank hull. Two pairs of frame members 18 extend forwardly from transverse beam 20, each pair of frame members has a rotatably supporting shaft 19 and optionally supporting a transverse bar 31. A set of disks 17 is eccentrically and rotatably mounted on shaft 19, the disks being arranged in close, face-to-face relationship and held on shaft 19 by frame members 18. Preferably, there is a slight amount of slack between the disks in the direction of the longitudinal axis of shaft 19 so that the disks can rotate independently of one another about shaft 19. For mine rollers provided with transverse bars 31, an arcuate slot 33 is provided in each disk to allow a limited angular movement of disk 17 about shaft 19.

Figure 6:
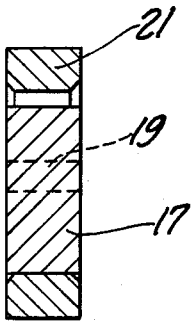
FIG. 6 is a sectional view along 6—6 in FIG. 5.

Rotatably mounted to the outer diametrical periphery of disks 17 are ground engaging annuluses 21 which preferably have the same axial width as the disks. The inner diameter of the annuluses may be bevelled as shown in FIG. 6 so that the annulus mounted one one disk will not catch on the outer edge of an adjoining disk when the various disk/annulus assemblies pivot independently of one another about shaft 19. The free ends of frame members 18 preferably do not extend beyond the outer diametrical edges of annuluses 21, no matter what the rotational position of the disk/annulus assemblies are relative to shaft 19. In this way, the front ends of frame members 18 will not jab into the side of a sloped area which the mine roller is approaching.

Figure 4:
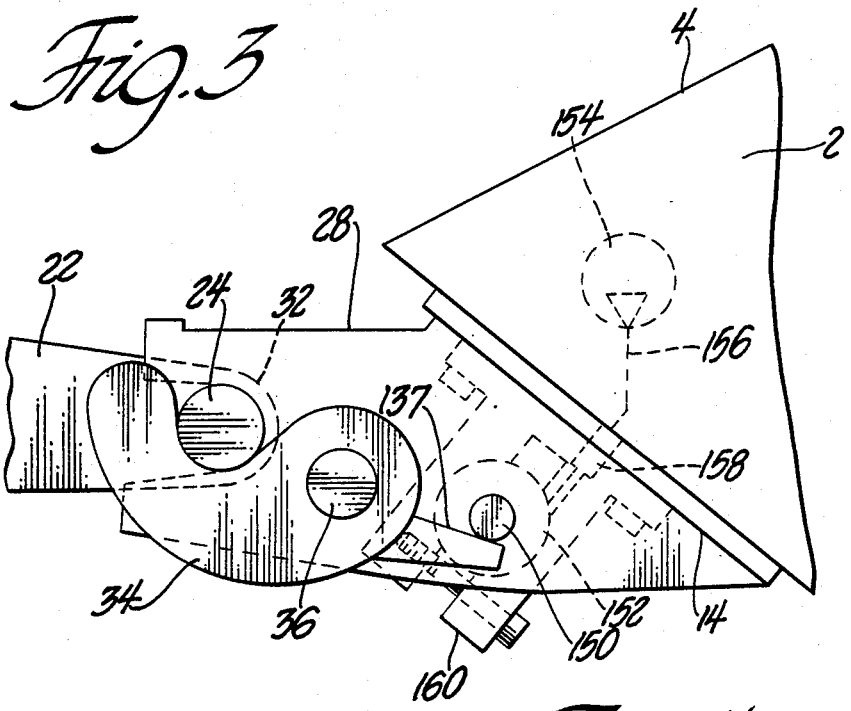
FIG. 4 is a latching mechanism by which the mine roller can be pivotally locked to a tank.

FIG. 4 shows a latch mechanism for locking pins 24 of the mine roller to bracket arms 28, the mechanism including a hook 34 fixed to a shaft 36 rotatably connected between bracket arms 28. Hook 34 has a finger 137 for engaging a translatable pin 150, which is extended from or retracted into bracket arm 28 by transversely extending hydraulic cylinder 152. Cylinder 152 is actuated by fluid from pressure source 154 inside the tank, the pressure source communicating with the cylinder via line 156 and fitting 158. A suitable bracket 160 holds cylinder 152 in fixed relation to base member 14. Cylinder 152 preferably contains a spring (not shown) which biases pin 150 to its extended position, so that pin 150 engages finger 137 and prevents hook 34 from leaving its FIG. 4 position, whereby pins 24 are locked into slots 32 of arms 28. When pressure source 154 is actuated, fluid pressure is communicated to cylinder 152 for overcoming the bias of the spring so as to retract pin 150. Hook 34 then swings downward under the influence of its own weight, thereby releasing pin 24. The FIG. 4 latch mechanism is believed advantageous since it allows the mine roller to be released by a switch inside the tank. The latch mechanism of FIG. 4 is essentially that shown in my U.S. patent application Ser. No. 150,113, now U.S. Pat. No. 4,813,698, filed Jan. 29, 1988.

Figure 3:
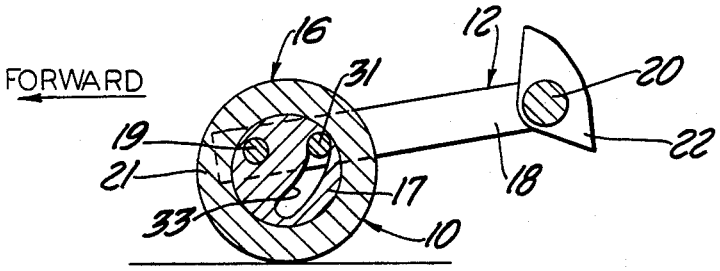
FIG. 3 is a variation of the sectional view shown in FIG. 2 showing a different position of a wheel-like structure comprised of a disk and an annulus rotatable thereon.
Figure 5:
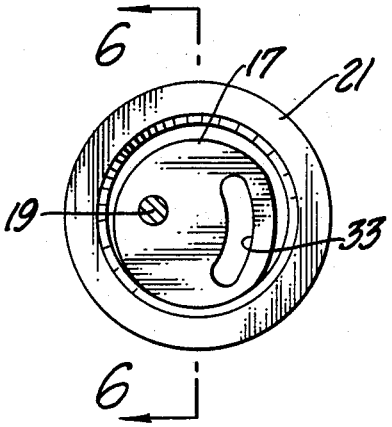
FIG. 5 shows an alternate embodiment of the wheel-like structure.

As shown in FIGS. 5 and 6, the outer diameter of disk 17 may be somewhat smaller than the inner diameter of ground engaging annulus 21. This feature will insure freewheeling of annulus 21 on disk 17 and allow more vertical play of annulus 21 as the mine roller tracks over uneven ground. In such a case, it will also be advantageous for the forward ends frame members 18 (FIGS. 2 and 3) to extend beyond the frontal portion of the inner diametrical edge of annulus 21. In this way, the forward ends of frame members 18 will help prevent annuluses 21 from slipping off the forward edges of the disks. The forward ends of frame members may be rounded as a further means to prevent member 18 from digging into the sides of slopes.

Figure 7:
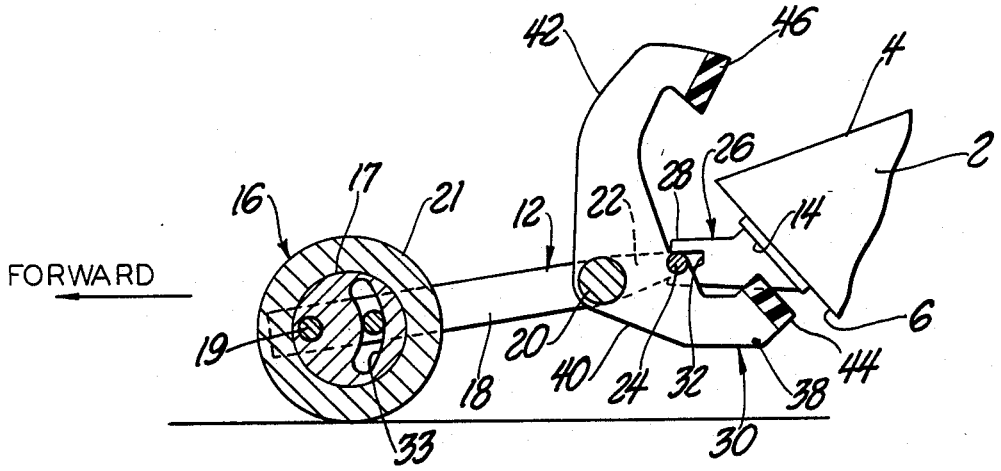
FIG. 7 shows an alternate embodiment of the mine roller having two cantilever members to limit rotation of the mine roller.

One optional feature of the invention shown in FIG. 7 is a generally C-shaped bumper assembly 30 fixed to transverse beam 20 of mine roller frame 12. Bumper assembly 30 has an arcuate lower cantilever member 40 at whose terminus is an elastomeric pad 44 and an upper arcuate cantilever member 42 at whose terminus is an elastomeric pad 46. When mine roller 16 detonates a land mine, the resulting explosion pivots the mine roller upward and clockwise as viewed in FIG. 7. Cantilever member 42 also pivots clockwise, but does so only until pad 46 hits upper surface 4, so the disk/annulus assembly 17/21 does not strike surface 4. Elastomeric pad 46 protects cantilever member 42 and pins 24 and brackets 28 by absorbing some of the shock resulting when cantilever member 42 strikes against upper surface 4.

Cantilever member 42 can be made of a suitably flexible material such that this member acts as a cantilever spring when it strikes upper surface 4, whereby both elastomeric member 46 and cantilever member 46 absorb shock when cantilever member 42 strikes upper surface 4. The respective resiliencies or spring rates of the elastomeric pad 46 and the main body will be different so that cantilever member 42 will function as a compound spring. To achieve the compound spring construction, the main body of cantilever member 42 may, for example, be made from steel similar to that used for leaf springs in vehicle suspensions while elastomeric member can be made of rubber having a "Shore A" durometer reading between 70 and 90. The main body may also be of a fiber reinforced resin construction that has been proposed for non-metallic springs for vehicle suspensions.

Lower cantilever member 40 will have a construction similar to that of cantilever member 42. When the mine roller rebounds downward after member 42 strikes surface 4, cantilever member 40 keeps the mine roller from falling into the hole caused by a mine explosion. Cantilever member 40 makes it impossible for the tank to run over the roller and damage both itself and the roller. Elastomeric member 44 on cantilever member 40 absorbs shock when cantilever member 40 strikes lower surface 6 of the tank hull, and cantilever member 40 can be a shock-absorbing spring in much the same fashion as cantilever member 42. Preferably, no point on cantilever member 40 is further from the axis of pins 24 than the distance between pins 24 and the ground, so that cantilever member 40 does not dig into the ground while rotating about pins 24. In FIG. 7, point 38 is the portion of the cantilever member most remote from the axis of pins 24 and is closer to pin 24 than pin 24 is to the ground.

Figure 8:
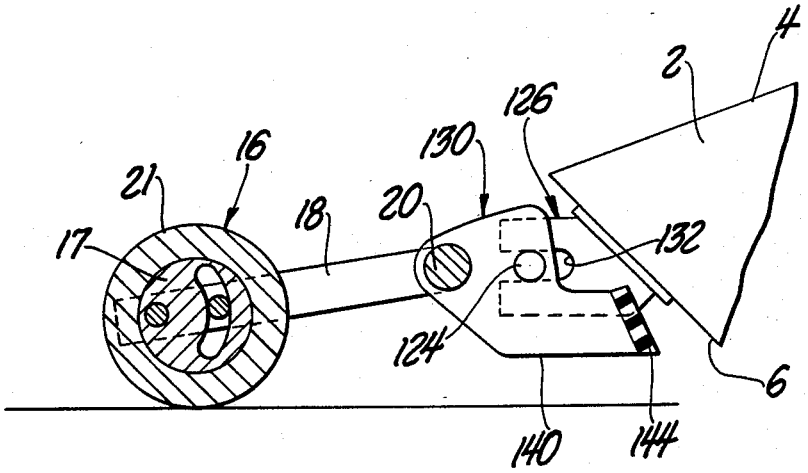
FIG. 8 shows an alternate embodiment of the mine roller having a single cantilever member to limit rotation of the mine roller.

A modified bumper assembly is shown in FIG. 8 having only one, lower cantilever arm 140, which has at its terminus an elastomeric member 144. The entire mine roller, including arm 140, pivots about pins 124, arm 140 being long enough to engage the ground after sufficient clockwise rotation from its FIG. 8 position. The engagement of arm 140 with the ground prevents the disk/annulus assembly 17/21 from striking the upper surface 4 of tank hull 2. Pins 124 and bracket assembly 126 are preferably larger and stronger than in the FIG. 2 embodiment so as to better withstand shocks when member 140 stikes the ground after a mine explosion. Slot 132 is similar to slot 32 except that slot 132 is widened to accommodate pin 124, whose diameter is larger than that of pin 24.

I wish it to be understood that I do not desire to be limited to the exact details of the various constructions shown and described herein because obvious modifications may occur to those persons skilled in the art without departing from the scope of the following claims.

I claim:

1. A mine roller attached to a military vehicle, comprising:

a frame;

means attached to the frame for connecting the mine roller to the vehicle;

a transverse member fixed to the frame;

a pair of parallel arms on the transverse frame member extending away from the vehicle;

a transverse rod connected between the ends of the parallel arms remote from the transverse frame member;

at least two disks mounted for eccentric rotation about the transverse rod;

a ground engagement annulus rotatable on the outer periphery of each disk.

2. The mine roller of claim 1 further comprising a governor bar connected between the parallel arms and pasing through the disks, the disks defining arcuate slots therein to accommodate the bar, whereby the disks have an arc of swing about the transverse rod limited by the governor bar.

3. The mine roller of claim 1 including means for restricting the vertical swinging of the mine roller relative to the vehicle, the limiting means including a bumper arm extending from the frame to a zone between the vehicle and the ground, the distance between the axis of vertical swinging of the mine roller and the ground being less than the distance between the axis of vertical swinging and a selected portion of the bumper arm.

4. The mine roller of claim 1 wherein at least a portion of one of the annuluses is further from the vehicle than the ends of the parallel arms.

5. The mine roller of claim 4 wherein the annuluses define inner and outer diameters, the inner diameter of the annuluses having remote inner diameter portions further away from the vehicle than other portions of the inner diameters and wherein the ends of the parallel arms extend away from the vehicle past portions.

6. The mine roller of claim 5 wherein the ends of the parallel arms are rounded.

7. The mine roller of claim 5 wherein the outer diameter of the disks is diametrically smaller than the inner diameter of the annuluses, whereby the annuluses have vertical play relative to the disks.

8. The mine roller of claim 7 wherein adjacent disks and adjacent annuluses define a slight axial gap therebetween, whereby the disks move independently of one another and the annuluses move independently of one another, the edges on inner diametrical surfaces of the annuluses being bevelled so that an annulus on one disk does not catch on one of the adjacent disks.

9. The mine roller of claim 1 including means for limiting the up-and-down swinging of the mine roller relative to the vehicle, the limiting means including a cantilever spring extending from the frame of the mine roller and rotating therewith.

10. The mine roller of claim 9 wherein the limiting means includes two cantilever springs extending from the frame of the mine roller and disposed so that a portion of the vehicle lies between the free ends of the cantilever springs.

11. The mine roller of claim 9 wherein the rotational path of the free end of the cantilever spring is blocked by the vehicle, whereby the cantilever spring limits the swinging of the mine roller relative to the vehicle.

12. The mine roller of claim 11 including an elastomeric spring member at the free end of the cantilever spring for cushioning the blow of the cantilever spring against the vehicle.

13. The mine roller of claim 12 wherein the elastomeric spring member and the cantilever spring have different spring rates.

14. A mine roller and a mechanism for pivotally connecting the mine roller to a military tank, comprising:

a pair of closely spaced bracket plates extending from the tank toward the mine roller, the plates defining elongate slots open toward the mine roller;

a frame having a transverse frame member and an interleaf plate extending from the transverse frame member between the spaced bracket plates, the interleaf plate having transverse pins engagable with the slots in the bracket plates;

a hook rotatably connected to one of the bracket plates, the hook swingable to a first position to engage one of the transverse pin and having a finger fixed thereto, whereby the finger rotates with the hook;

a hydraulic cylinder fixed relative to the bracket plates, the cylinder having a lock pin extendable therefrom to engage the finger, thereby preventing the hook from disengaging the transverse pin.

a pair of parallel arms on the transverse frame member extending away from the vehicle;

a transverse rod connected between the ends of the parallel arms remote from the transverse member;

at least two disks mounted for eccentric rotation about the transverse rod;

a ground engagement annulus rotatable on the outer periphery of each disk.

means for restricting the vertical swinging of the mine roller relative to the vehicle, the limiting means including a bumper arm extending from the frame to a zone between the vehicle and the ground.

* * * * *